US009776825B2

(12) United States Patent
Tsai

(10) Patent No.: US 9,776,825 B2
(45) Date of Patent: Oct. 3, 2017

(54) FOLDING ROLLER MODULE WITH COMBINED BEARING UNIT

(71) Applicant: CHAN LI MACHINERY CO., LTD., Taoyuan (TW)

(72) Inventor: Tung-I Tsai, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 713 days.

(21) Appl. No.: 14/246,406

(22) Filed: Apr. 7, 2014

(65) Prior Publication Data

US 2015/0105233 A1 Apr. 16, 2015

(30) Foreign Application Priority Data

Oct. 14, 2013 (TW) ..... 102136916 A

(51) Int. Cl.
*B65H 45/12* (2006.01)
*B65H 27/00* (2006.01)

(52) U.S. Cl.
CPC ..... *B65H 45/12* (2013.01); *B65H 27/00* (2013.01); *B65H 2404/1321* (2013.01); *B65H 2404/17* (2013.01)

(58) Field of Classification Search
None
See application file for complete search history.

(56) References Cited

U.S. PATENT DOCUMENTS 2,718,670 A * 9/1955 Harley, Sr. ..... D01H 5/64 19/265
3,044,766 A * 7/1962 Banks ..... B65H 45/20 493/433
3,382,660 A * 5/1968 Whitehurst ..... D01H 1/04 384/498
3,796,423 A * 3/1974 Shuster ..... B65H 27/00 100/176
3,847,260 A * 11/1974 Fowler ..... B65G 39/04 193/37
5,688,217 A * 11/1997 Izume ..... B41F 31/14 492/39
6,477,952 B1 * 11/2002 Izume ..... B41F 31/14 101/352.11
7,097,607 B2 * 8/2006 De Matteis ..... B65H 45/24 493/344
7,798,949 B2 * 9/2010 Vaaraniemi ..... F16C 13/028 492/39

(Continued)

FOREIGN PATENT DOCUMENTS

EP 2860138 A1 4/2015
JP 2748254 B2 2/1998

(Continued)

*Primary Examiner* — Hemant M Desai
*Assistant Examiner* — Tanzim Imam
(74) *Attorney, Agent, or Firm* — Rosenberg, Klein & Lee

(57) ABSTRACT

A folding roller module with combined bearing unit is disclosed. The folding roller module of the present invention comprises a folding roller and a plurality of combined bearing unit. In the present invention, a plurality of combined bearing unit are used to support the folding roller at suitable locations for enhancing the strength of the folding roller module, reducing the deformation of the folding roller, and reducing the vibration during operation.

5 Claims, 5 Drawing Sheets

(56) References Cited

U.S. PATENT DOCUMENTS

| | | | | |
|---|---|---|---|---|
| 8,172,212 | B2 * | 5/2012 | Lien | B65H 31/32 270/39.01 |
| 2002/0077235 | A1 * | 6/2002 | Munsche | B65H 23/0258 492/38 |
| 2004/0235633 | A1 | 11/2004 | De Matteis | |
| 2005/0070418 | A1 * | 3/2005 | Haasl | B65H 45/165 493/434 |
| 2005/0211273 | A1 * | 9/2005 | Hein | B65H 27/00 134/21 |
| 2009/0137375 | A1 * | 5/2009 | Tsai | B31F 1/10 493/442 |
| 2011/0036254 | A1 * | 2/2011 | Ebert | B41F 13/08 101/409 |
| 2012/0270716 | A1 * | 10/2012 | Kauppila | B65H 27/00 493/454 |

FOREIGN PATENT DOCUMENTS

| | | | |
|---|---|---|---|
| JP | 2004-149319 | A | 5/2004 |
| JP | 2009-126712 | A | 6/2009 |
| JP | 2012-177480 | A | 9/2012 |
| JP | 2013-32818 | A | 2/2013 |
| TW | 526146 | | 4/2003 |
| TW | I365844 | | 6/2012 |

* cited by examiner

FOLDING ROLLER MODULE WITH COMBINED BEARING UNIT

FIELD OF THE INVENTION

The present invention relates to a folding roller module, and more particularly to a folding roller module with combined bearing unit.

BACKGROUND OF THE INVENTION

Referring to FIG. 1, there is shown a schematic diagram of a folding apparatus according to the prior art. The folding apparatus comprises a pair of fixed knives 12, a pair of cutting rollers 14, a pair of folding rollers 16, and a pair of folding fingers 18.

In general, the web material 11 is cut by the fixed knives 12 and the cutting rollers 14 into a plurality of sheets of web material with the same size. The plurality of sheets of web material are then fed to the pair of folding rollers 16 to form folding lines at predetermined location. The pair of folding fingers 18 are adapted to stack up the plurality of sheets of web material to an interfolded web material 13.

The distance between the pair of folding rollers 16 affects the quality of products greatly. If the folding rollers 16 are too close to each other, collisions may occur during operation, that the web material and the equipment may be damaged. If the folding rollers 16 are too far from each other, the folding line will be too dim, and the folding quality of the product will be greatly affected.

In the prior art, a folding roller 16 is supported only by three bearing units 17 located on both sides and the middle of the folding roller 16. The wider the folding roller is, the greater the deformation and vibration are during operation.

SUMMARY OF THE PRESENT INVENTION

It is an objective of the present invention to provide a folding roller module, and more particularly to a folding roller module with combined bearing unit.

It is another objective of the present invention to provide a folding roller module with combined bearing unit for enhancing the strength of the folding roller module.

It is still another objective of the present invention to provide a folding roller module with combined bearing unit, wherein the number of the combined bearing units can be increased for enhancing the strength of the folding roller module.

The present invention provides a folding roller module with combined bearing unit, comprising: a folding roller having a shaft and a plurality of folding wheels; and a plurality of combined bearing units, wherein each of the combined bearing units comprises a frame, two C-bearings, and a cap for supporting the folding roller at suitable location.

In one embodiment of the present invention, each of the folding wheels is disposed on the shaft and is separated to each other by a gap, and each of the combined bearing units is disposed in the gap.

In one embodiment of the present invention, the C-bearings of each of the bearing units are disposed around the shaft in the gap and secured by the frame and the cap.

In one embodiment of the present invention, the cap of each of the bearing units is fastened to the frame by one or more bolts.

In one embodiment of the present invention, each of the folding wheels comprises a plurality of tips and a plurality of grooves disposed on the folding wheel alternately with suitable distance.

In one embodiment of the present invention, a plurality of suction holes are disposed around the tips and the grooves of each of the folding wheels.

DETAILED DESCRIPTION OF THE PREFERRED EMBODIMENTS

Figure 1:
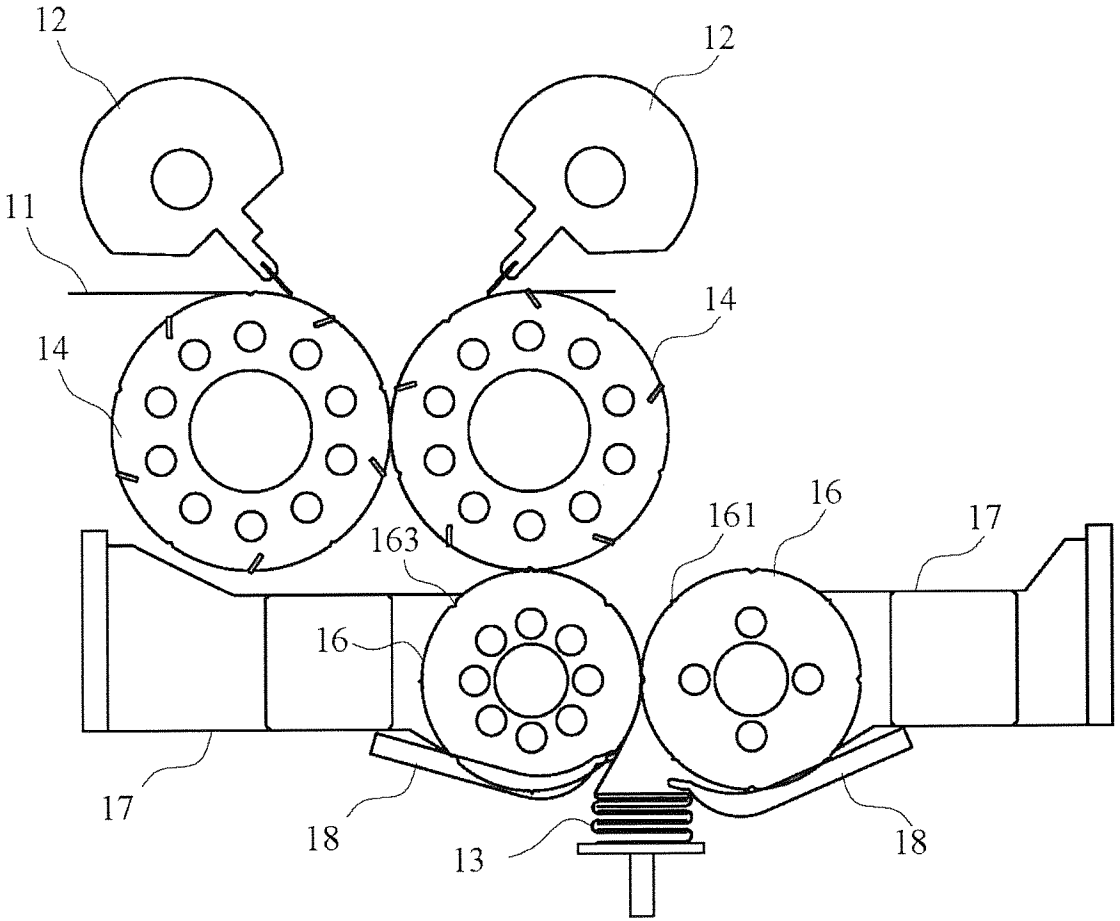
FIG. 1 is schematic diagram of a folding apparatus according to the prior art.
Figure 2:
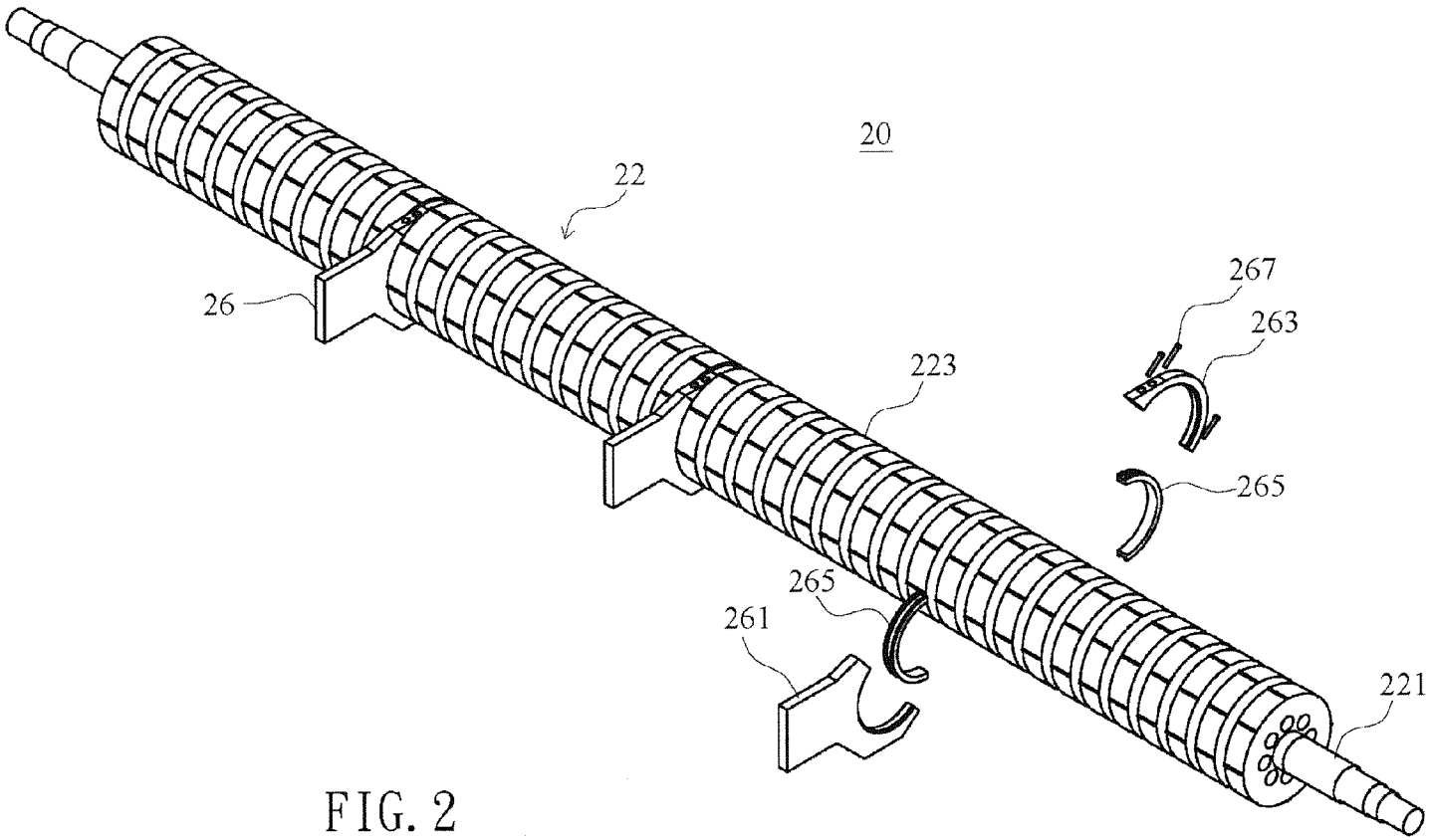
FIG. 2 is a schematic diagram of a folding roller module with combined bearing unit in accordance with one embodiment of the present invention.
Figure 3:
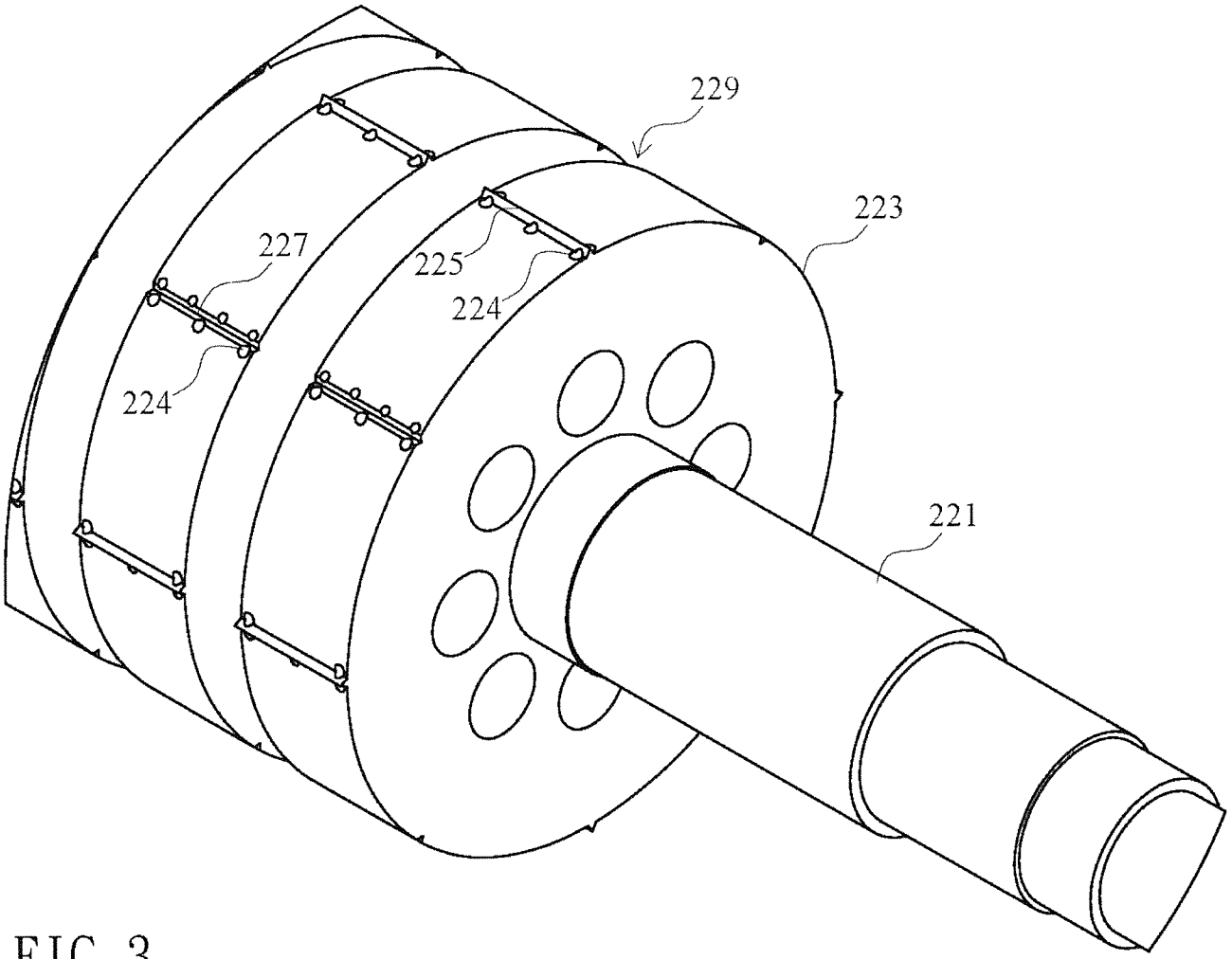
FIG. 3 is a schematic enlarged partial view of the folding roller module with combined bearing unit in accordance with the embodiment shown in FIG. 2.
Figure 4:
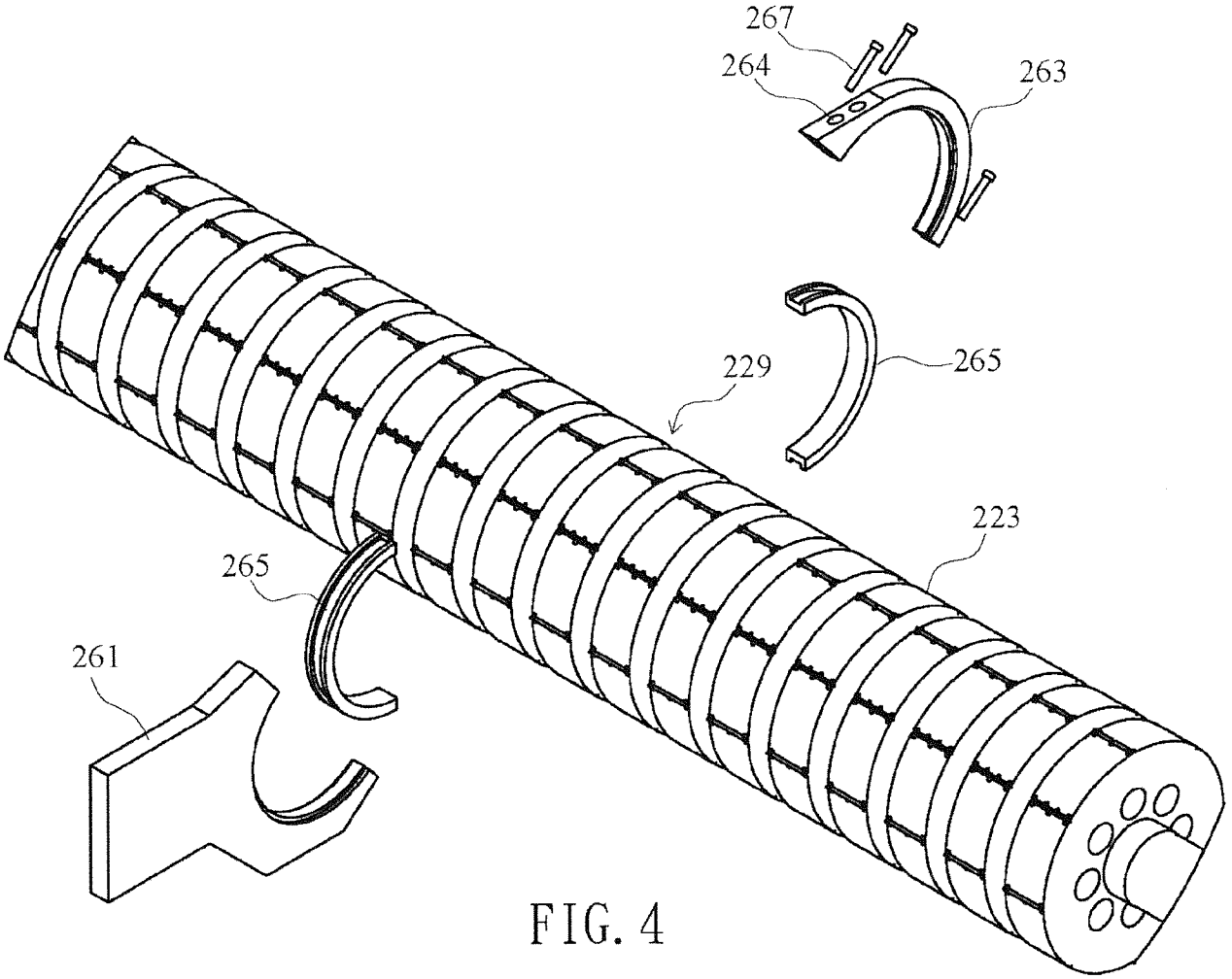
FIG. 4 is another schematic enlarged partial view of the folding roller module with combined bearing unit in accordance with the embodiment shown in FIG. 2.
Figure 5:
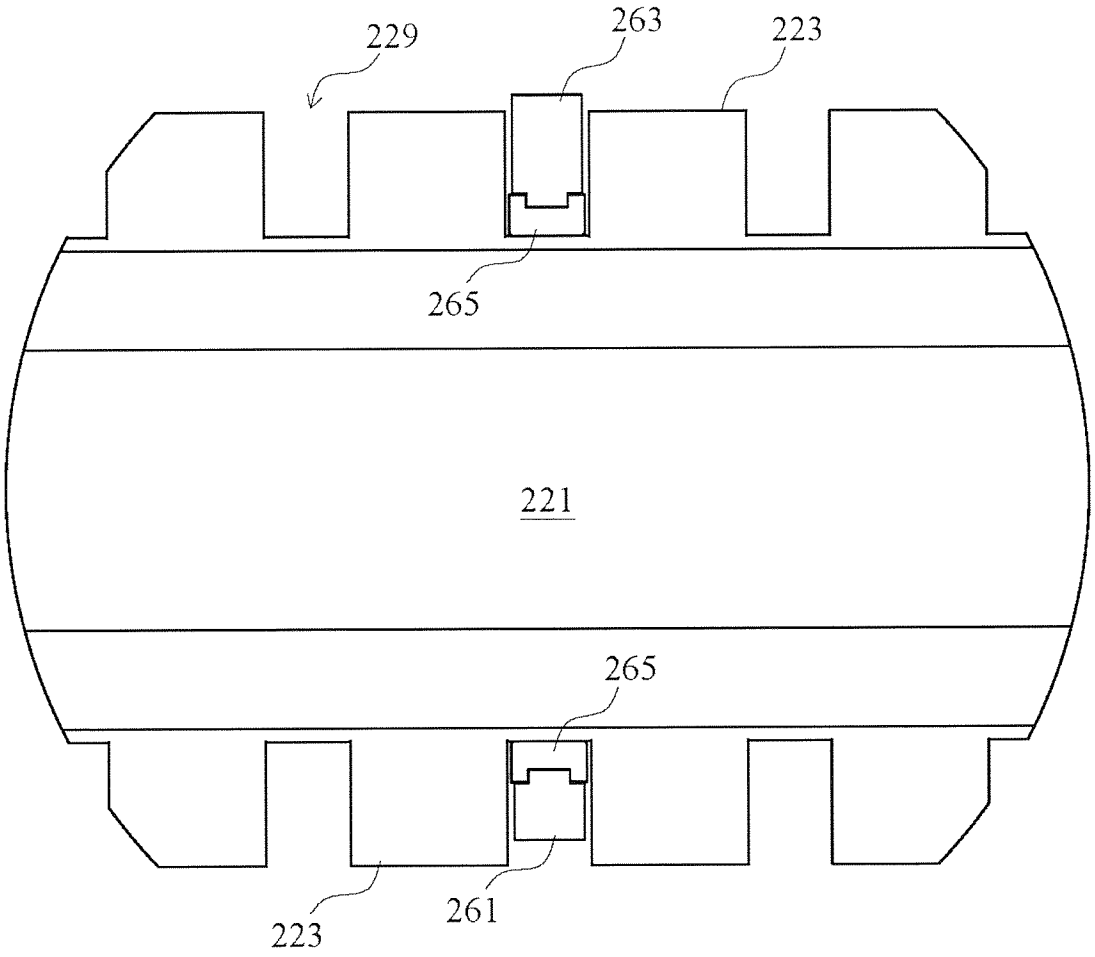
FIG. 5 is a sectional partial view of the folding roller module with combined bearing unit in accordance with the embodiment shown in FIG. 2.

Referring to FIGS. 2-5, a schematic diagram, schematic enlarged partial views, and a sectional partial view of a folding roller module with combined bearing unit in accordance with one embodiment of the present invention are illustrated. In the present embodiment, the folding roller module 20 with combined bearing unit comprises a folding roller 22 and a plurality of combined bearing unit 26.

The folding roller 22 comprises a shaft 221 and a plurality of folding wheels 223. Each of the combined bearing unit 26 comprises a frame 261, two C-bearings 265, and a cap 263. In the present embodiment, the plurality of combined bearing unit 26 can support the folding roller 22 at suitable locations for enhancing the strength of the folding roller module 20, reducing the deformation of the folding roller 22, and reducing the vibration during operation.

In one embodiment of the present invention, each of the folding wheels 223 is disposed on the shaft 221 and is separated to each other by a gap 229. The combined bearing units 26 are disposed in the gaps of suitable locations for supporting the folding roller 22.

In one embodiment of the present invention, the C-bearings 265 of the combined bearing unit 26 are disposed around the shaft 221 in the gap 229 and secured by the frame 261 and the cap 263.

In one embodiment of the present invention, tapped holes (not shown) and through holes 264 are disposed on the frame 261 and the cap 263 respectively. The cap 263 is fastened to the frame 261 by bolts 267.

In one embodiment of the present invention, each of the folding wheels 223 comprises a plurality of tips 225 and a plurality of grooves 227 disposed on the folding wheel 223 alternately with suitable distance.

In one embodiment of the present invention, a plurality of suction holes 224 are disposed around the tips 225 and the grooves 227. The web material is sucked and attached to the surface of the folding wheel 223.

By using the folding roller module 20 with combined bearing unit of the present invention, a plurality of combined bearing unit 26 can support the folding roller 22 at suitable locations for enhancing the strength of the folding roller module 20, reducing the deformation of the folding roller 22, and reducing the vibration during operation.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A folding roller module with combined bearing unit, comprising:

a folding roller having a shaft and a plurality of spaced folding wheels disposed on the shaft, each of the folding wheels being spaced one from another by a gap to define a respective recess therebetween, each recess being radially spaced from the shaft; and a plurality of combined bearing units supporting the folding roller, wherein each of the combined bearing units includes a frame, two C-bearings, and a cap for supporting the folding roller at a suitable location, the two C-bearings of each of the plurality of combined bearing units being disposed in a corresponding one of the recesses.

2. The folding roller module as claimed in claim 1, wherein the C-bearings of each of the combined bearing units are secured by the frame and the cap.

3. The folding roller module as claimed in claim 1, wherein the cap of each of the combined bearing units is fastened to the frame by one or more bolts.

4. The folding roller module as claimed in claim 1, wherein each of the folding wheels comprises a plurality of tips and a plurality of grooves disposed alternately on the folding wheel, wherein a distance between each tip and an adjacent groove is constant.

5. The folding roller module as claimed in claim 4, wherein a plurality of suction holes are disposed around the tips and the grooves of each of the folding wheels.

* * * * *